US006517355B1

(12) United States Patent
Long et al.

(10) Patent No.: US 6,517,355 B1
(45) Date of Patent: Feb. 11, 2003

(54) MAGNETICALLY RESPONSIVE WRITING DEVICE WITH AUTOMATED OUTPUT

(75) Inventors: Jennifer Long, Providence, RI (US); Natasha Berling, Cranston, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 09/855,888

(22) Filed: May 15, 2001

(51) Int. Cl.[7] ..... B43L 1/12
(52) U.S. Cl. ..... 434/409; 434/428; 446/129
(58) Field of Search ..... 434/408, 409, 434/410, 415, 416, 428; 446/129, 132, 146

(56) References Cited

U.S. PATENT DOCUMENTS

| | | | | |
|---|---|---|---|---|
| 1,881,140 A | | 10/1932 | Settel | |
| 3,585,735 A | * | 6/1971 | Miller | 434/409 |
| 4,143,472 A | | 3/1979 | Murata et al. | |
| 4,288,936 A | * | 9/1981 | Okutsu | 40/426 |
| 4,451,985 A | | 6/1984 | Pullman | |
| 4,761,243 A | | 8/1988 | Kakuishi et al. | |
| 4,804,327 A | * | 2/1989 | Miller | 434/409 |
| 4,931,019 A | * | 6/1990 | Park | 310/311 |
| 4,992,190 A | | 2/1991 | Shtarkman | |
| 5,487,840 A | | 1/1996 | Yabe et al. | |
| 5,516,445 A | | 5/1996 | Sasaki et al. | |
| 5,523,157 A | | 6/1996 | Sasaki et al. | |
| 5,599,474 A | | 2/1997 | Weiss et al. | |
| 5,604,517 A | | 2/1997 | Filo | |
| 5,820,385 A | | 10/1998 | Ohashi et al. | |
| 5,863,455 A | | 1/1999 | Segal | |
| 5,997,309 A | | 12/1999 | Metheny et al. | |

* cited by examiner

*Primary Examiner*—Kien T. Nguyen
(74) *Attorney, Agent, or Firm*—Salter & Michaelson

(57) ABSTRACT

A magnetic writing device including a magnetically responsive writing tablet operatively connected to an automated output is disclosed. In one embodiment, the automated output is a sound produced as the user presses on the magnetic writing tablet. The writing tablet may be rotatably supported within a housing such that as a user presses on the writing tablet with a magnetically attractive stylus, the tablet rotates and engages a switch to activate the output device. In an exemplary embodiment, the switch is an elastomeric switch which activates an electronic sound unit in the housing to produce electronic sounds. The writing device may also include a magnetic eraser rotatably supported within the housing so as to rotate with the tablet. The magnetic eraser preferably engages an eraser surface of the tablet and is slidable there along so as to "erase" an image formed on the writing surface of the tablet.

26 Claims, 12 Drawing Sheets

MAGNETICALLY RESPONSIVE WRITING DEVICE WITH AUTOMATED OUTPUT

DESCRIPTION

1. Technical Field

The invention relates generally to a magnetically responsive writing device including a magnetic tablet and, more specifically to a magnetically responsive writing device which produces an output, for example a sound, as the user presses on the magnetic writing tablet.

2. Background of Related Art

Magnetically responsive writing devices which allow a user to draw or write on a tablet by using a magnetically attractive stylus and magnetic writing media are known in the art. One such writing device, also known as a magnetophoretic display panel, is disclosed in U.S. Pat. No. 4,143,472 to Murata. In Murata, the display panel includes a plurality of cells sandwiched between two substrates, each cell being filled with a liquid dispersion that comprises magnetic particles, a dispersion medium, a colorant and, optionally, a thickener. When a user applies a magnetic stylus to either substrate, the magnetic particles are attracted by the magnetic force of the stylus and move toward the surface of the liquid adjacent the substrate to produce a visual representation (or drawing). The visual representation is formed by the difference in contrast between the color of the liquid dispersion and that of the magnetic particles. The surface of the substrate can thereafter be "erased" by passing a magnet across the other surface to pull the magnetic particles away from the substrate writing surface.

Various other magnetically responsive writing tablets are also known in the art, utilizing other types of liquid dispersion. These writing tablets have been distributed by the toy industry as reusable drawing surfaces for children. Such toys have enjoyed success at least in part because they allow children to express themselves creatively and repeatedly in a simple manner. While such magnetic writing tablets have enjoyed success, there has also been development in the field to provide other enhancements to the magnetic writing devices.

SUMMARY

One object of the present invention to provide a magnetic writing device including a magnetically responsive writing tablet which allows a user to express him or herself artistically, and which is operatively connected to an automated output. In one embodiment, the automated output is a sound which is produced as the user presses on the magnetic writing tablet. The writing tablet is preferably rotatably supported within a housing such that as a user presses on the writing tablet with a magnetically attractive stylus, the tablet rotates about the hinge and engages a switch to activate the output device. In an exemplary embodiment, the switch is an elastomeric switch which activates an electronic sound unit in the housing to produce a variety of electronic sounds. The writing device may also include a magnetic eraser which may also be rotatably supported within the housing so as to rotate with the tablet. The magnetic eraser preferably engages an eraser surface of the tablet and is slidable there along so as to "erase" a user created image formed on the writing surface of the tablet. In one embodiment, a button for activating a second switch to produce the automated output may also be provided.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENT

Figure 1:
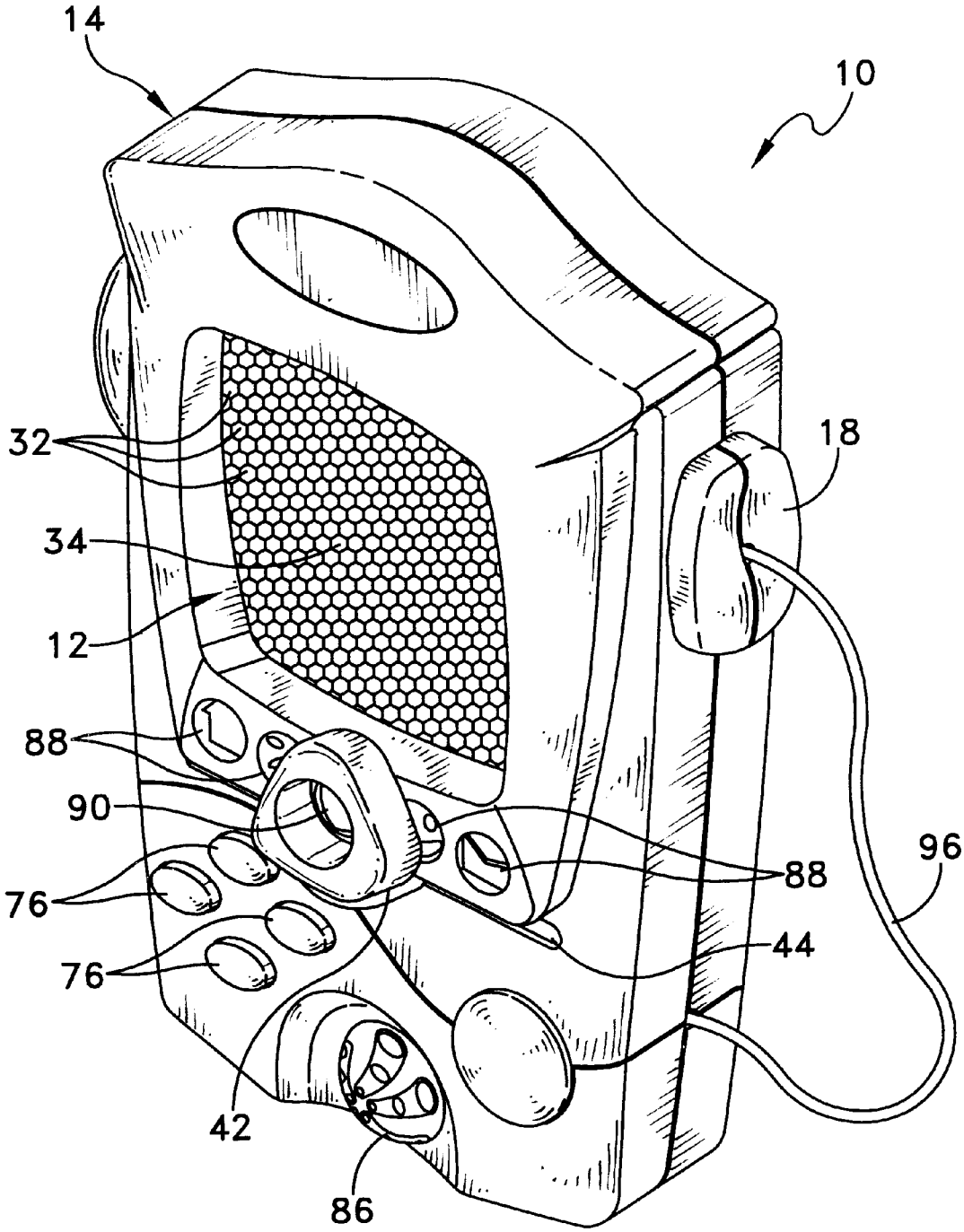
FIG. 1 is perspective view of a magnetically responsive writing device according to one embodiment of the invention.

A magnetic writing device 10, including a magnetically responsive tablet 12 and an automated output 16, is illustrated in FIGS. 1–15. The magnetic tablet 12 is preferably rotatably supported within a housing 14, and is operatively connected to the output device 16 (FIG. 5) which is also supported within the housing. As a user presses on the magnetic tablet, it is preferably urged into contact with a switch to activate the output device, as described in greater detail below.

Figure 2:
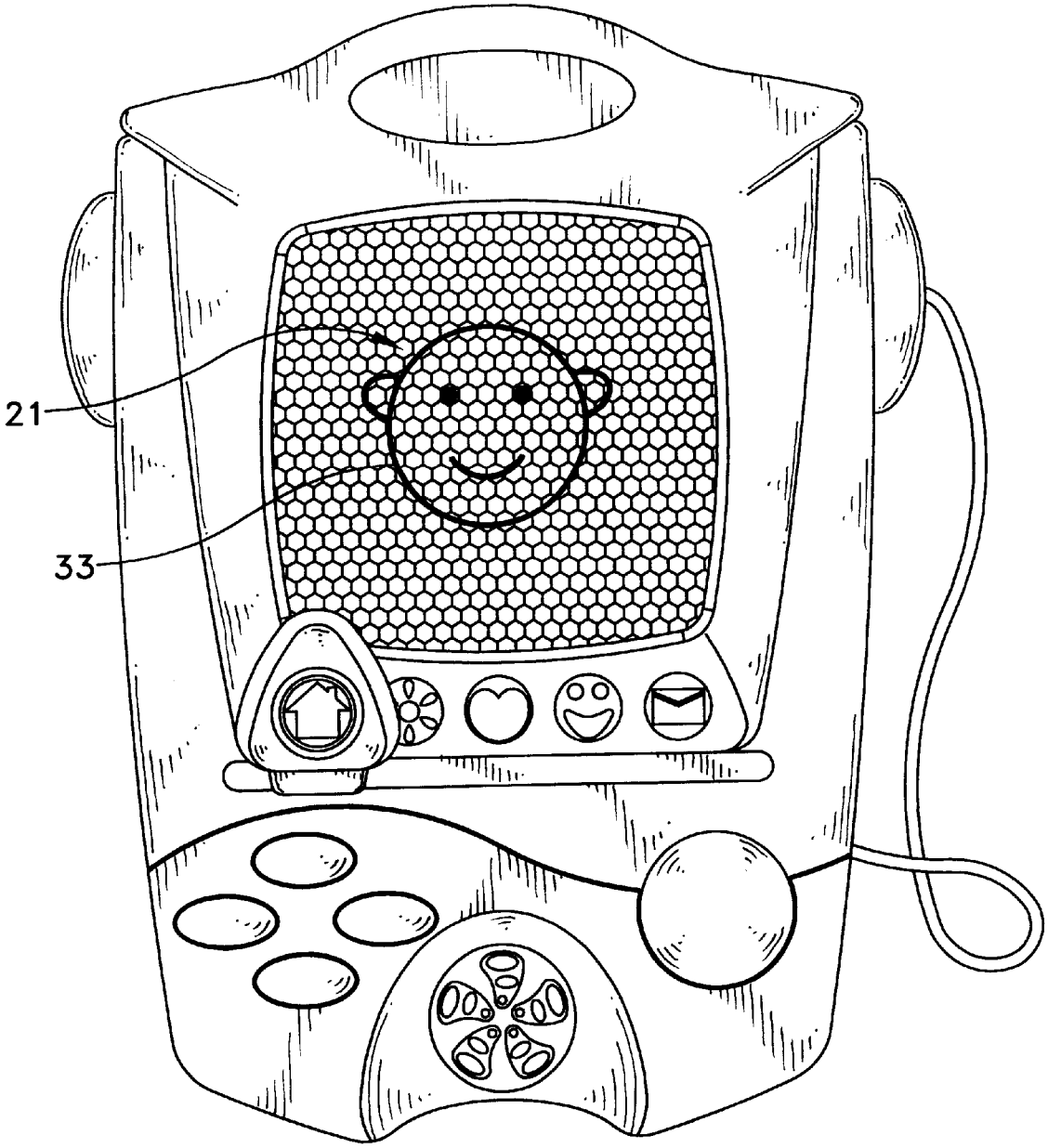
FIG. 2 is a front view of the magnetically responsive writing device of FIG. 1.
Figure 3:
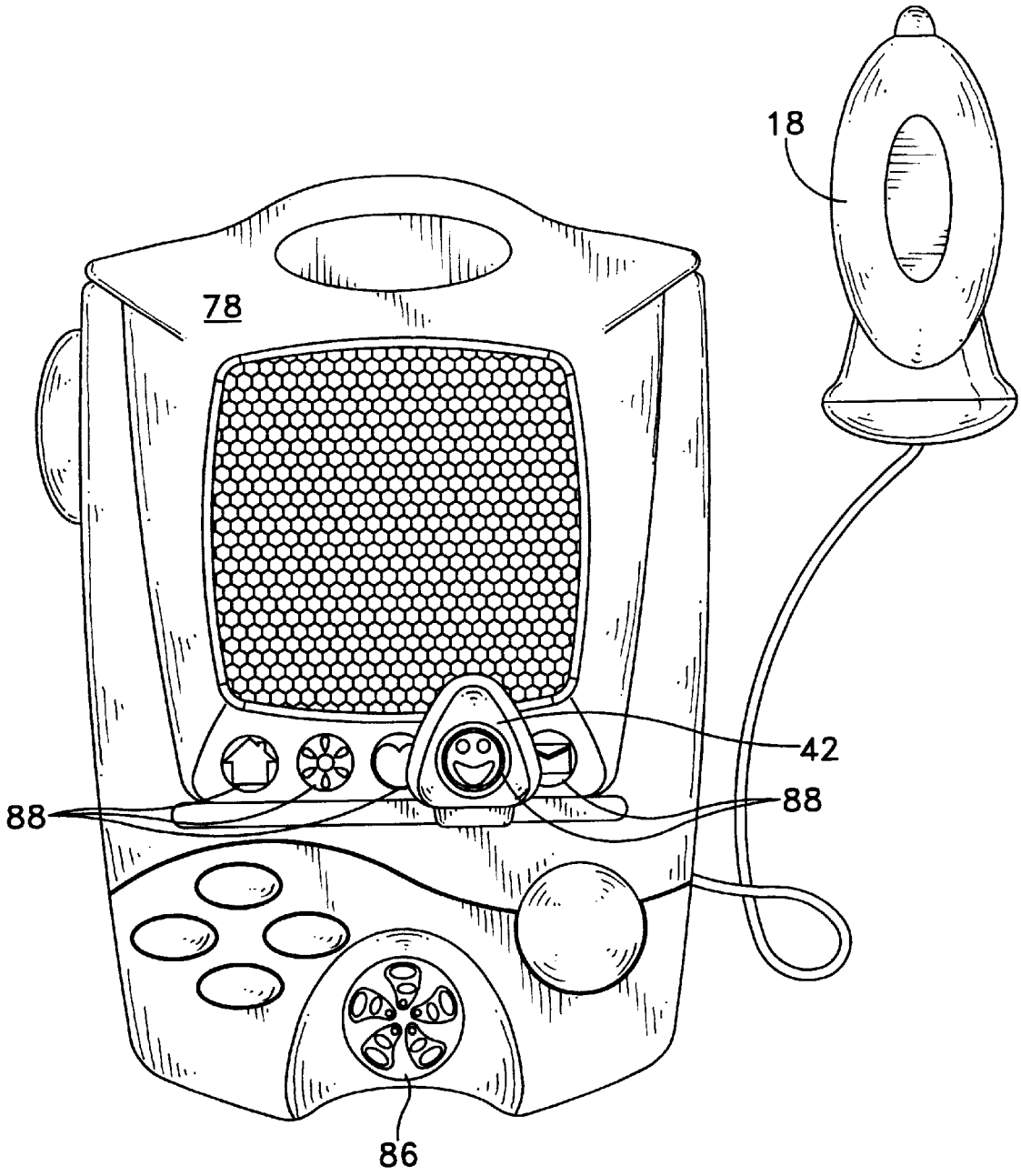
FIG. 3 is a front view of the magnetically responsive writing device of FIG. 1 with magnetic stylus removed.
Figure 7:
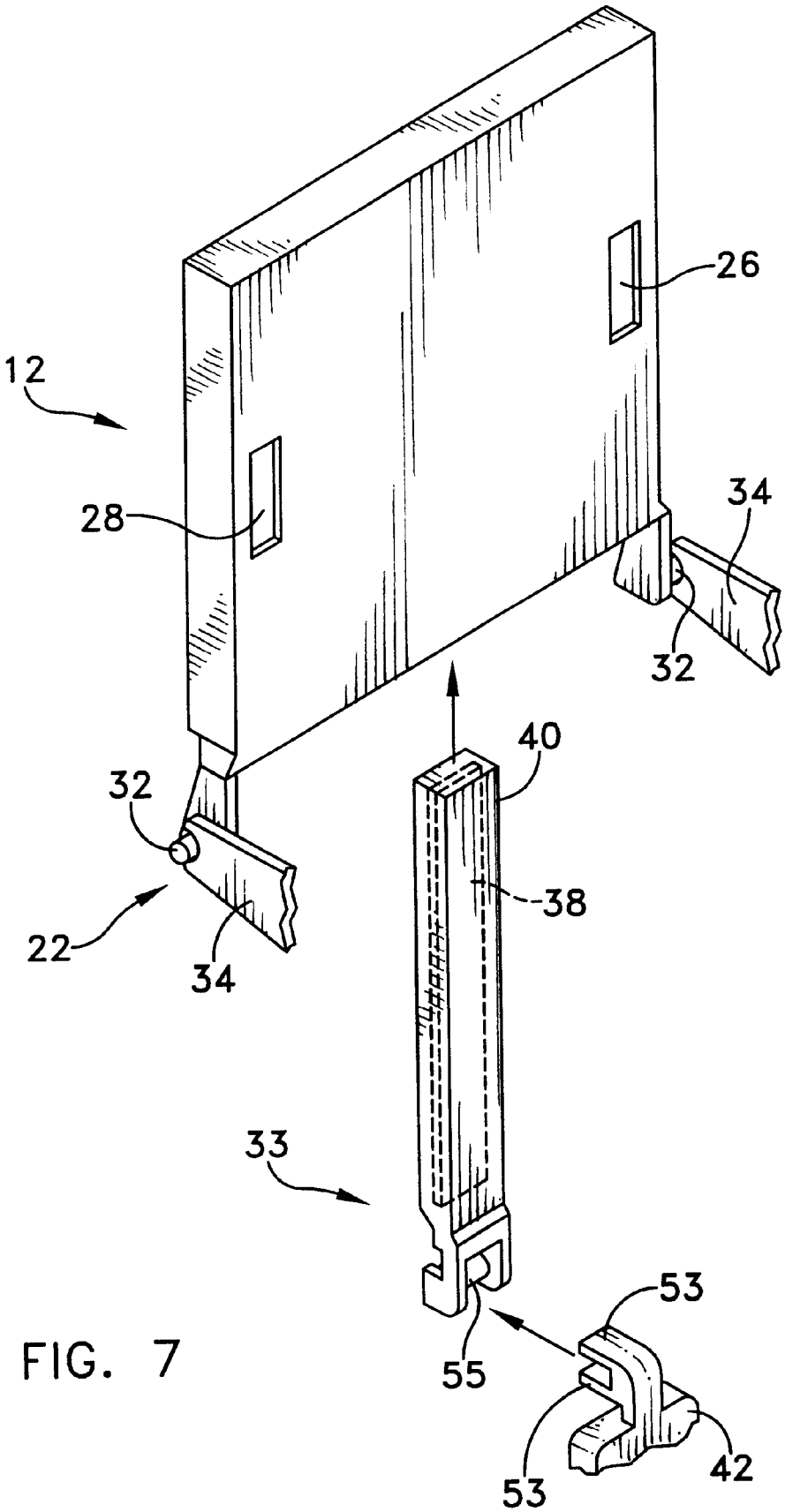
FIG. 7 is an exploded perspective view of the display panel and magnetic eraser.
Figure 8:
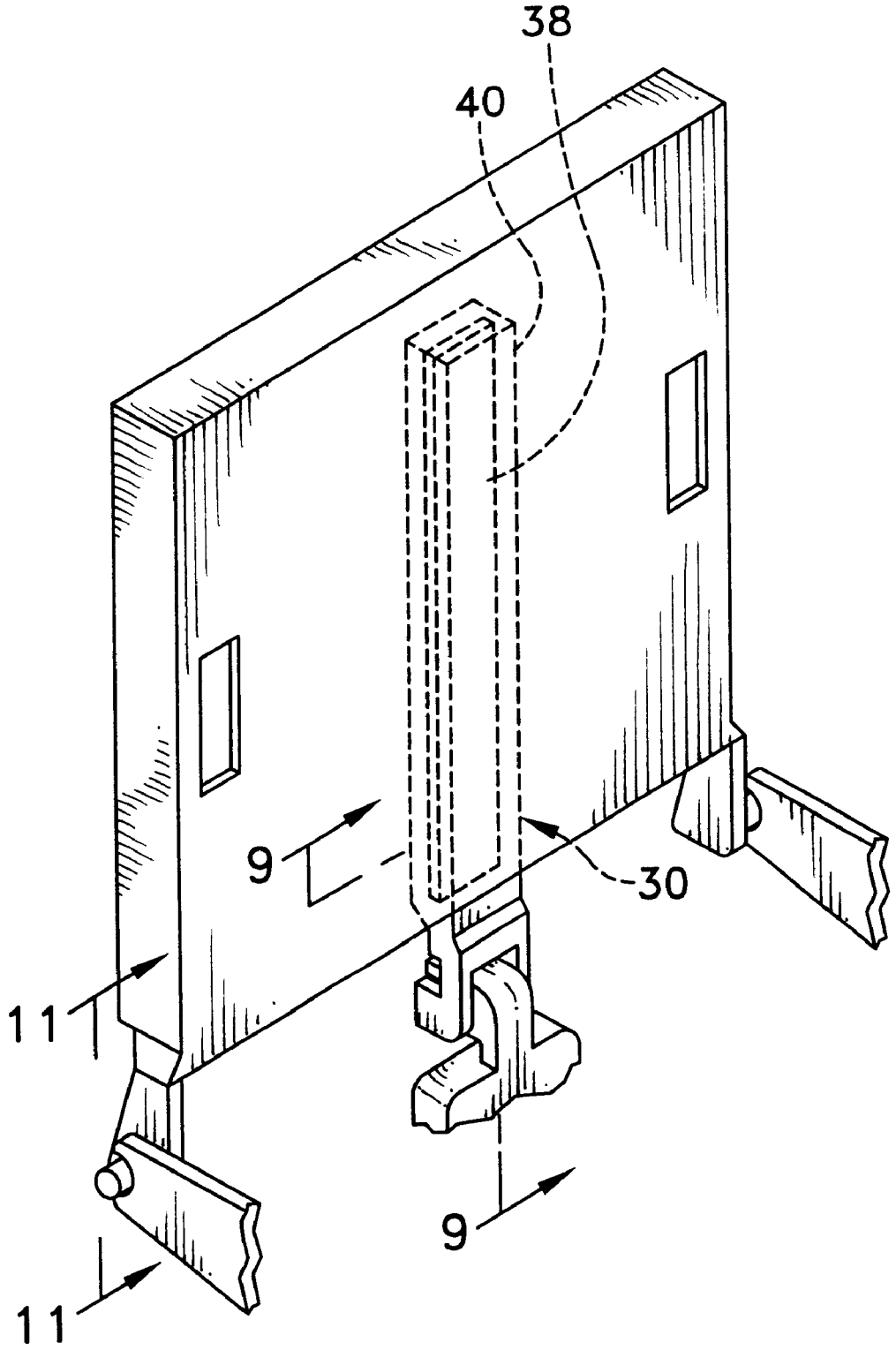
FIG. 8 is a perspective view of the display panel and magnetic eraser together.
Figure 9:
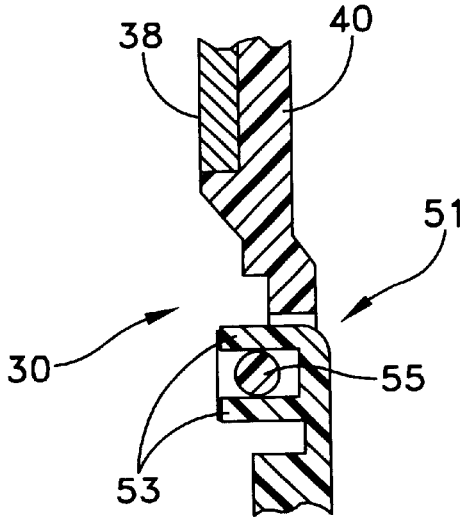
FIG. 9 is a side, cross-sectional view of the magnetic eraser of FIG. 8 taken along lines 9—9 in a non-rotated position.
Figure 10:
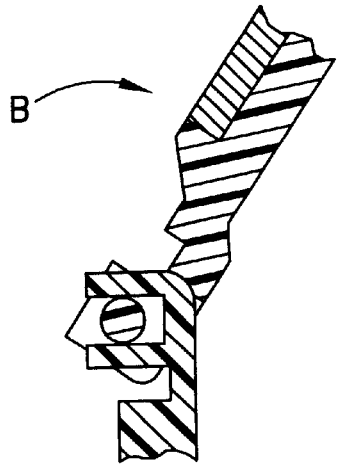
FIG. 10 is a side, cross-sectional view of the magnetic eraser of FIG. 9 in a rotated position.
Figure 11:
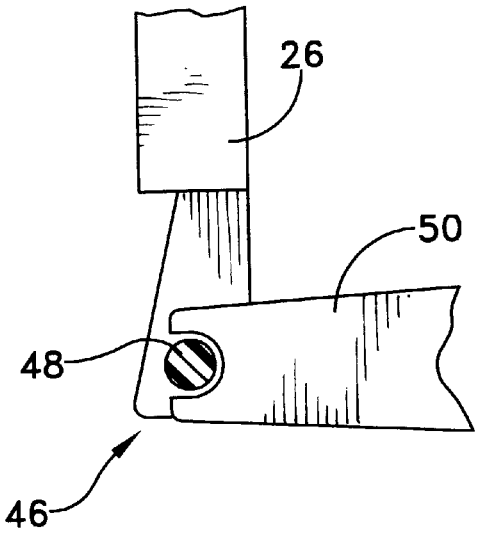
FIG. 11 is a side, cross-sectional view of the hinge member of the magnetic tablet of FIG. 8 taken along lines 11—11 in a non-rotated position.
Figure 12:
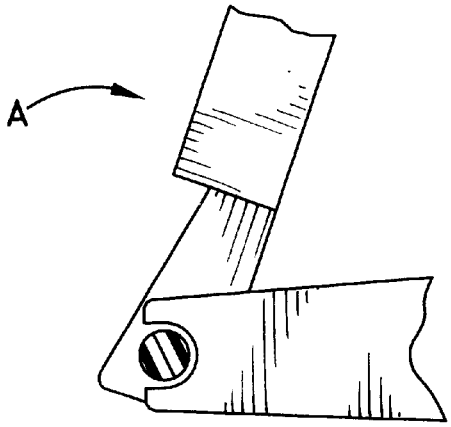
FIG. 12 is a side, cross-sectional view of the hinge member of the magnetic tablet of FIG. 11 in a rotated position.
Figure 13:
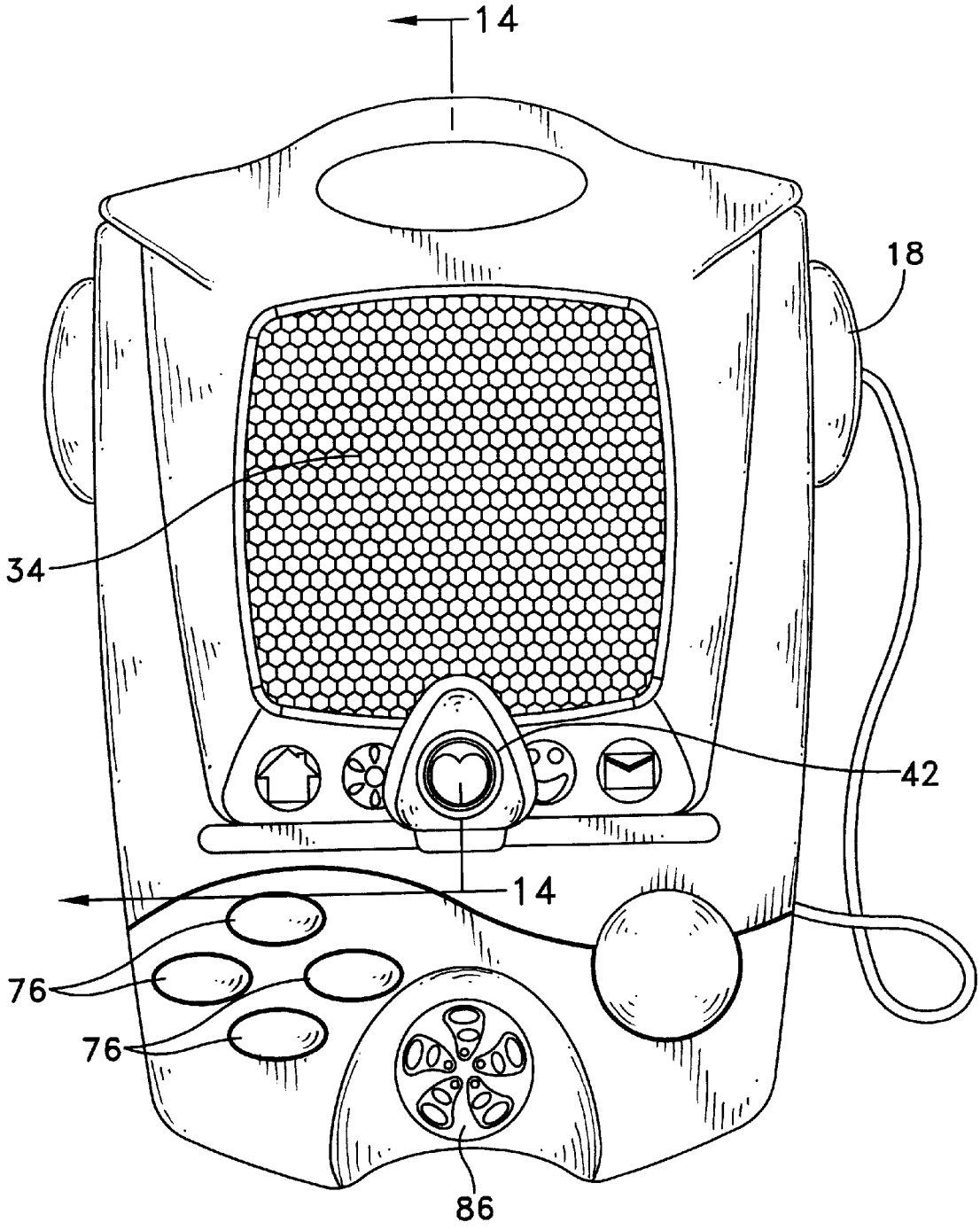
FIG. 13 is a front view of the magnetically responsive writing device of FIG. 1.

The magnetically responsive tablet 12 preferably includes a writing display panel 20 engageable by a magnetically attractive stylus 18 on at least one side thereof to produce and display an image 21 to the user (FIG. 2). The display panel 20 may be supported on mounting member 26 and a gap 28 may be disposed between the display panel and the mounting member for receiving a magnetic eraser 30 therein (FIG. 7). The display panel 20 preferably includes a plurality of cells 32 sandwiched between two substrates, each cell being filled with a liquid dispersion that includes magnetic particles 33, as is known in the art. In the present embodiment, the first or front substrate is utilized as the writing surface 34, while the second substrate is utilized as the eraser surface 36. When the user applies the magnetically attractive stylus 18 to the writing surface, the magnetic particles are attracted by the magnetic force of the stylus and move toward the surface of the liquid adjacent the writing surface to display a user created image or design. The image is formed by the difference in contrast between the color of the liquid dispersion and that of the magnetic particles, as is known in the art. The writing surface can thereafter be "erased" by passing magnetic eraser 30 across the eraser surface to pull the magnetic particles away from the substrate writing surface 34, as is also known in the art.

In the present embodiment, magnetic eraser 30 preferably includes a magnet 38 mounted within a support 40 which is rotatably supported within housing 14 (FIGS. 7–10). As described above, the magnet 38 is preferably disposed within gap 28 formed between the display panel and the mounting member and is disposed adjacent the eraser surface 36 of the display panel 20. The magnet 38 may preferably be rectangular in shape, extending between a top edge of the mounting panel to a bottom edge of the mounting panel. Support 40 may include an engagement member 42 which is slidably received within a slot 44 formed in a front member of the housing, and is moveable within the slot by the user. As the engagement member 42 is moved within the slot 44, the magnet 38 moves along the length of the eraser surface to attract the magnetic particles toward the eraser surface so as to "erase" the writing surface, as described herein above, and known in the art.

Referring now to FIGS. 7–8 and 14–15, the tablet is preferably rotatably supported within the housing 14 such that upon the stylus 18 contacting the display panel 20, the tablet rotates to activate the output device 16. In the present embodiment, the tablet may be rotatably supported by a hinge member 46 including a pair of engagement pins 48 supported on the tablet mounting member 26, the pins being secured within holders 50 supported on a rear member of the housing 14. In this manner, the mounting member 26 can rotate about pins 48 in the direction of arrow "A" as pressure is placed on the magnetic tablet, and in the reverse direction when the pressure is released. The magnetic eraser 30 may also preferably be rotatably supported within the housing 14 by a hinge 51. In the present embodiment, the hinge 51 may including a pair of prongs 53 extending from one end of the engagement member 42 and engaging pin 55 disposed on one end of the support 40, such that as the magnetic tablet is rotated in the direction of arrow "A", the magnet 38 is likewise rotated in the same direction as indicated by arrow "B" (FIG. 10) about pin 55. Alternate methods of rotatably securing the tablet and the magnetic eraser may be utilized, as would be known to those of skill in the art.

Figure 14:
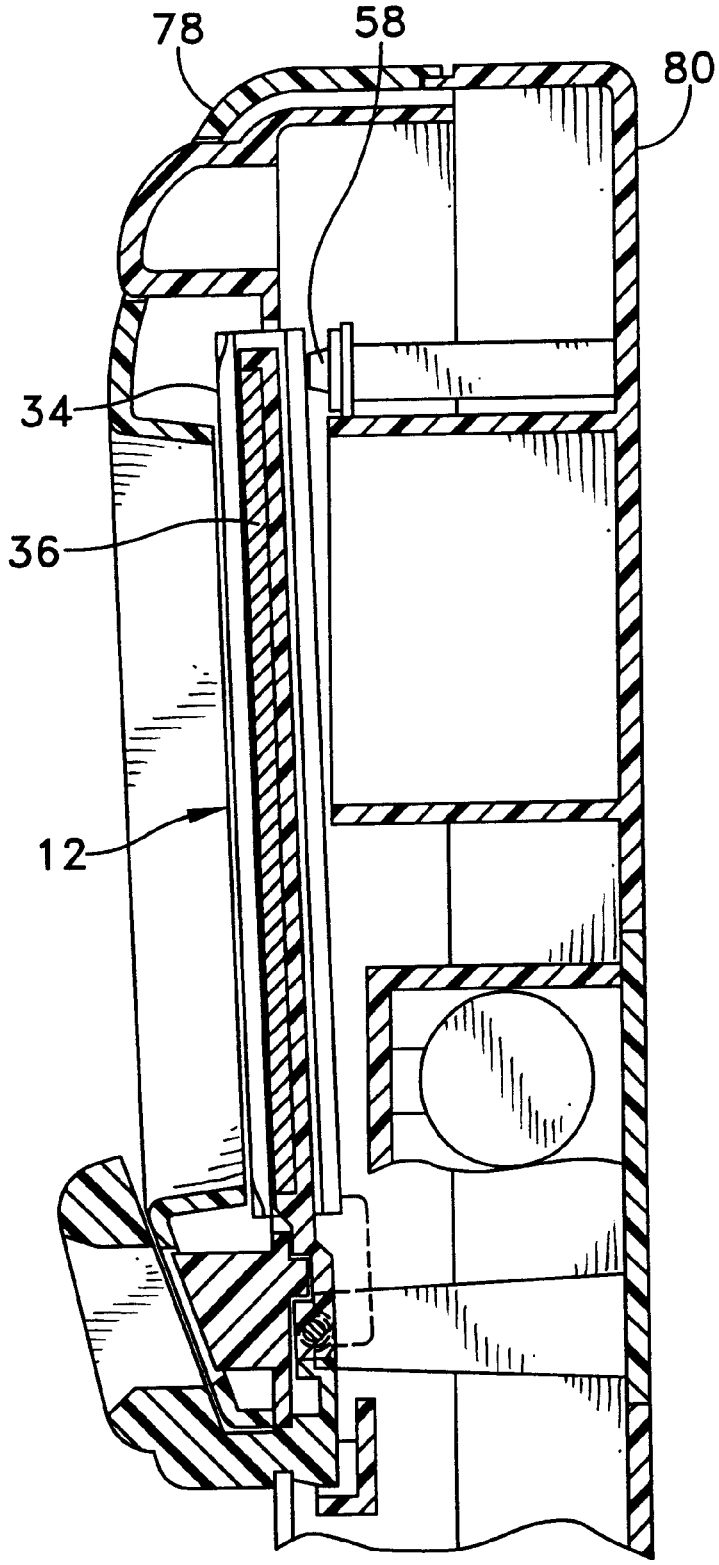
FIG. 14 is a side, cross-sectional view of the magnetically responsive writing device of FIG. 13 taken along lines 14—14 in a non-actuated position.
Figure 15:
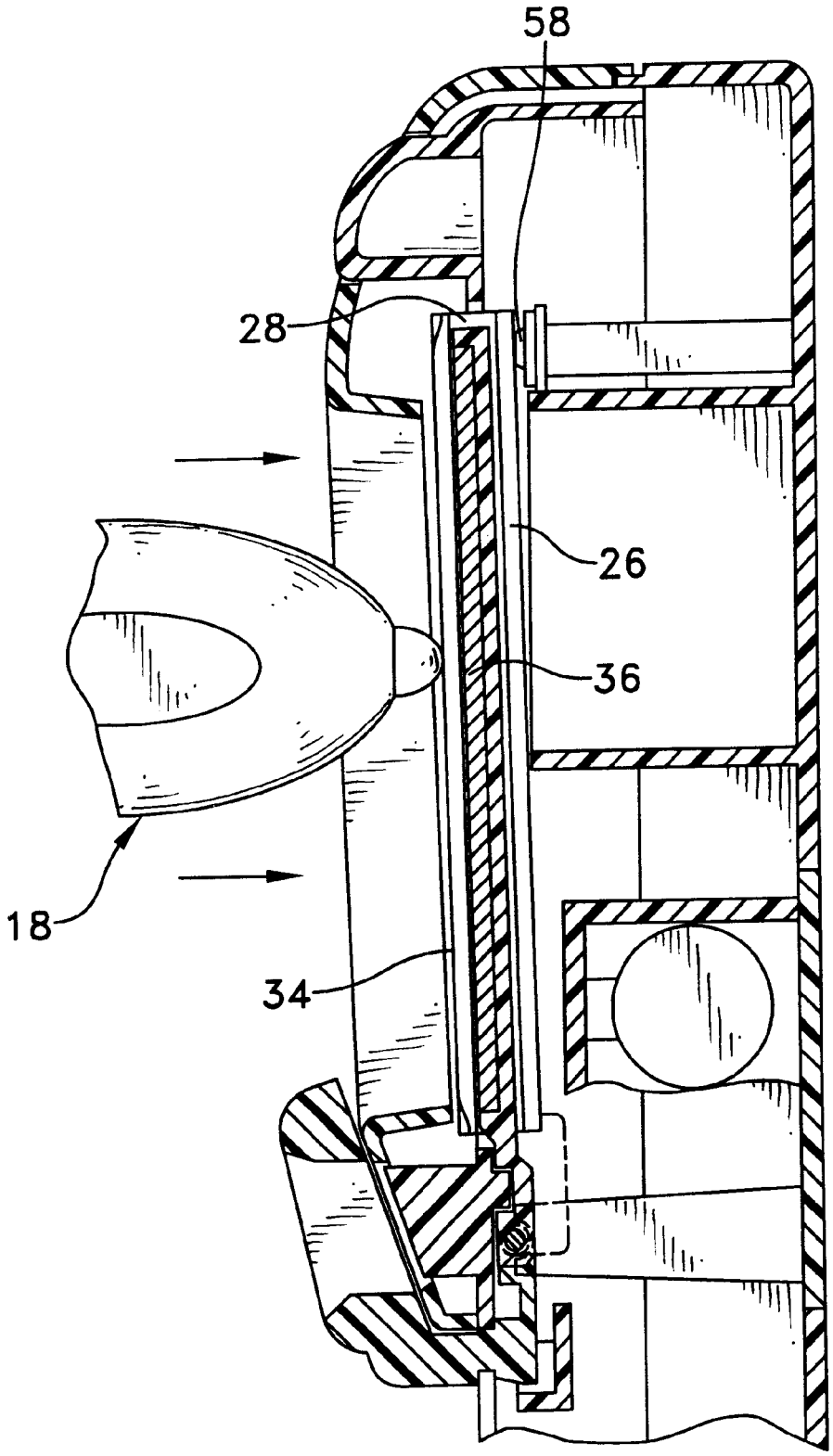
FIG. 15 is a side, cross-sectional view of the magnetically responsive writing device of FIG. 14 in an actuated position.

The tablet may be initially biased in a non-engaged or extended position by the hinge member 46, in which the output device is not activated (FIG. 14). As a user presses on any portion of the display panel with the stylus, the tablet preferably rotates about the hinge member 46 and engages switch 58 (FIG. 15) to activate the output device 16 and produce an automated output to the user, for example, through an audio or visual representation. In the present embodiment, the mounting member 26 preferably contacts an elastomeric switch 58 mounted to a circuit board 60 and electrically connected to a second circuit board 62 (FIG. 5), all of which are supported within the housing. As the circuit is closed, the output device produces one of number of a pre-recorded sounds which may preferably be stored on circuit board 62. Alternately, the tablet may be rotatably supported within the housing in contact with a switch such that as the user engages the tablet with the stylus, the tablet disengages the switch to activate the output device, as would be known to those of skill in the art.

Figure 5:
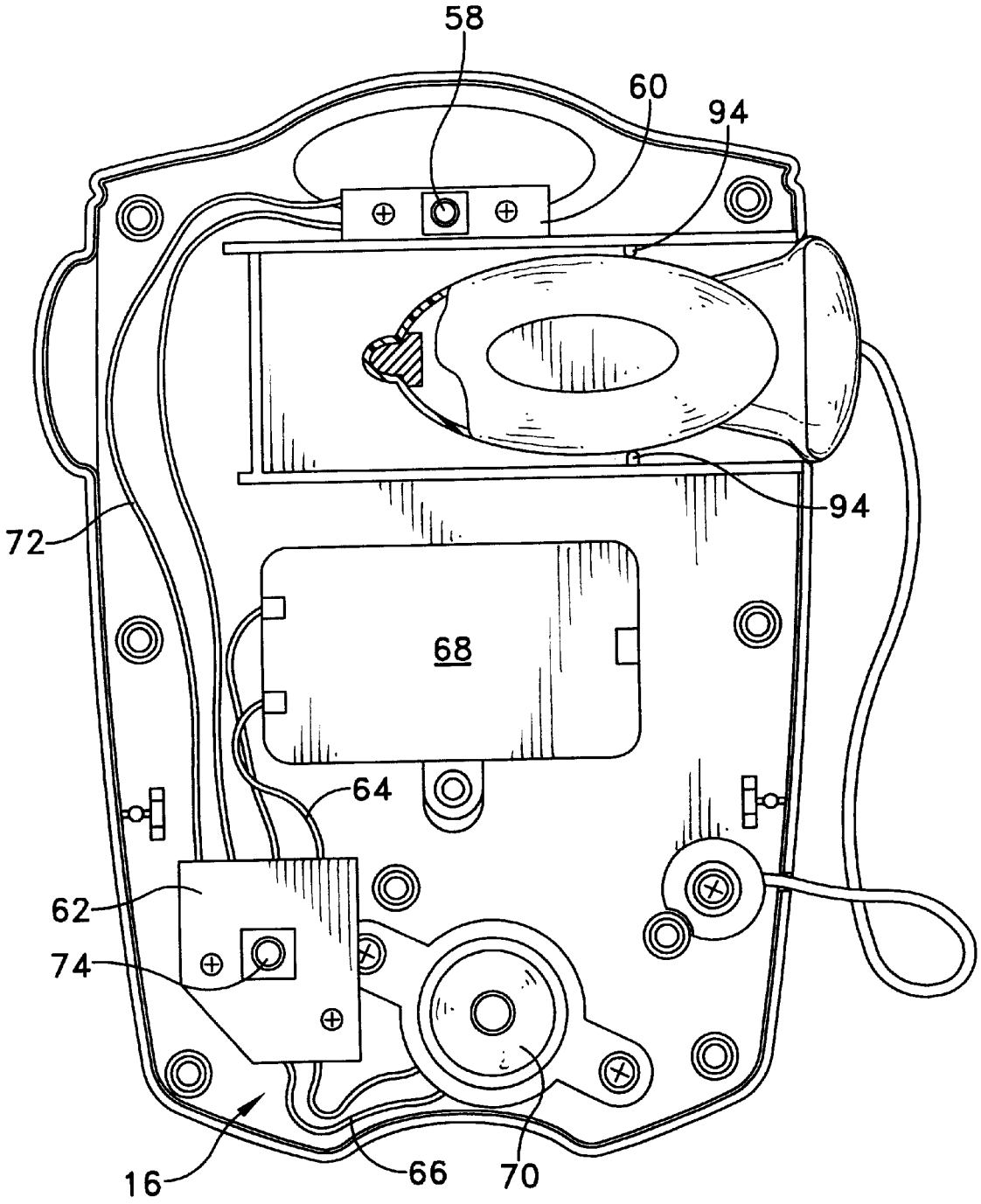
FIG. 5 is a front view of the magnetically responsive writing device of FIG. 1 with the front housing and magnetic tablet removed.
Figure 6:
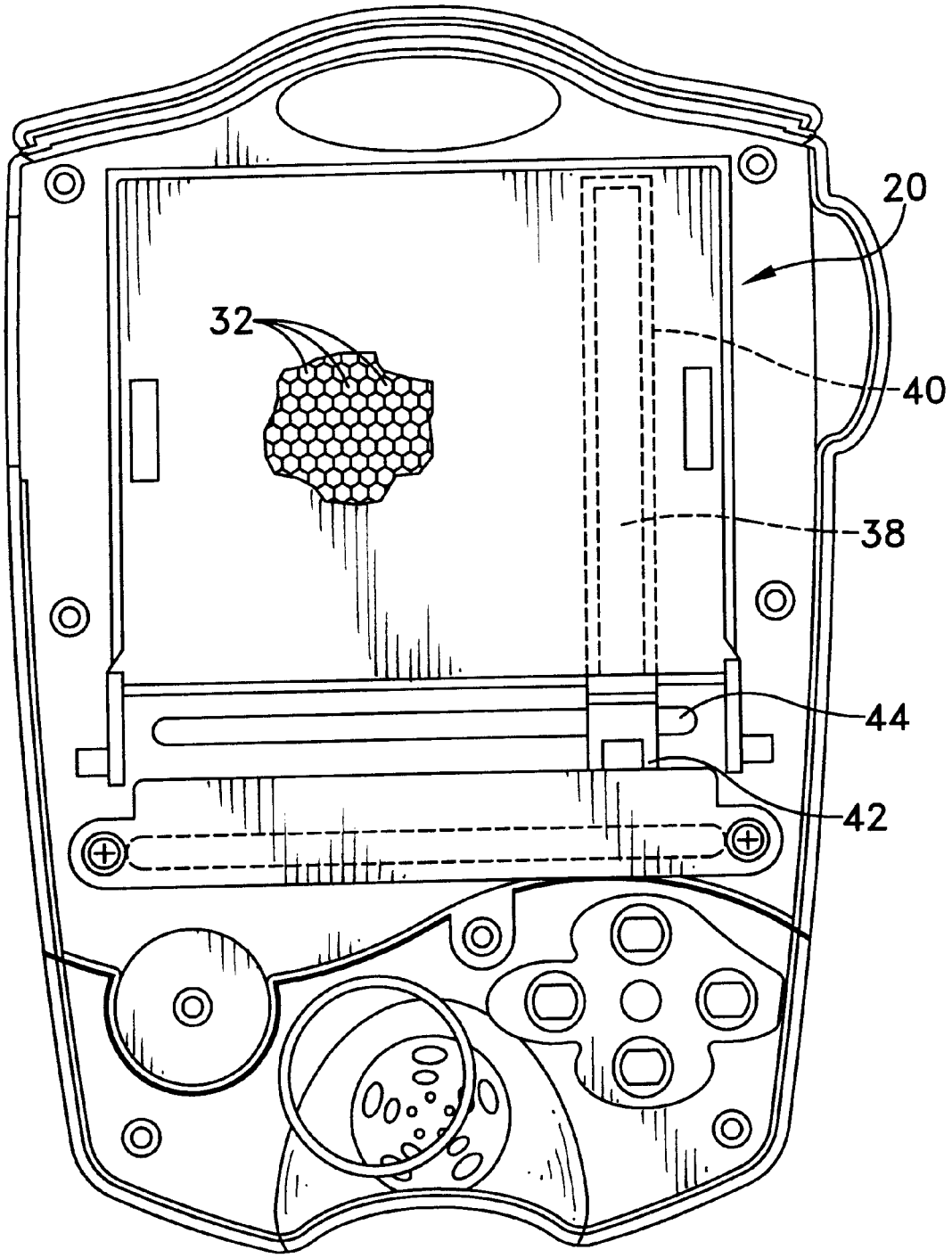
FIG. 6 is a rear view of the magnetically responsive writing device of FIG. 1 with the rear housing and output device removed.

The output device 16 of the present embodiment is most clearly illustrated in FIG. 5. The output device preferably includes at least one circuit board 62 containing one or more prerecorded sounds, which is electrically connected (such as by wires 64, 66) to a power supply 68 (for example batteries) and at least one speaker 70. In the present embodiment, the output device also preferably includes switch 58 mounted to circuit board 60, which is electrically connected via wires 72 to circuit board 62 such that actuation of the switch 58 causes the output device to be activated as described above. In addition, a second switch 74 may be provided which, when actuated also activates the output device. For example, one or more buttons 76 (FIG. 1) may be provided on the writing device which, when depressed by a user, contact elastomeric switch 74 in order to activate the output device. Alternate arrangements of the output device are possible, and more than one output device may be provided, as would be known to those of skill in the art.

Figure 4:
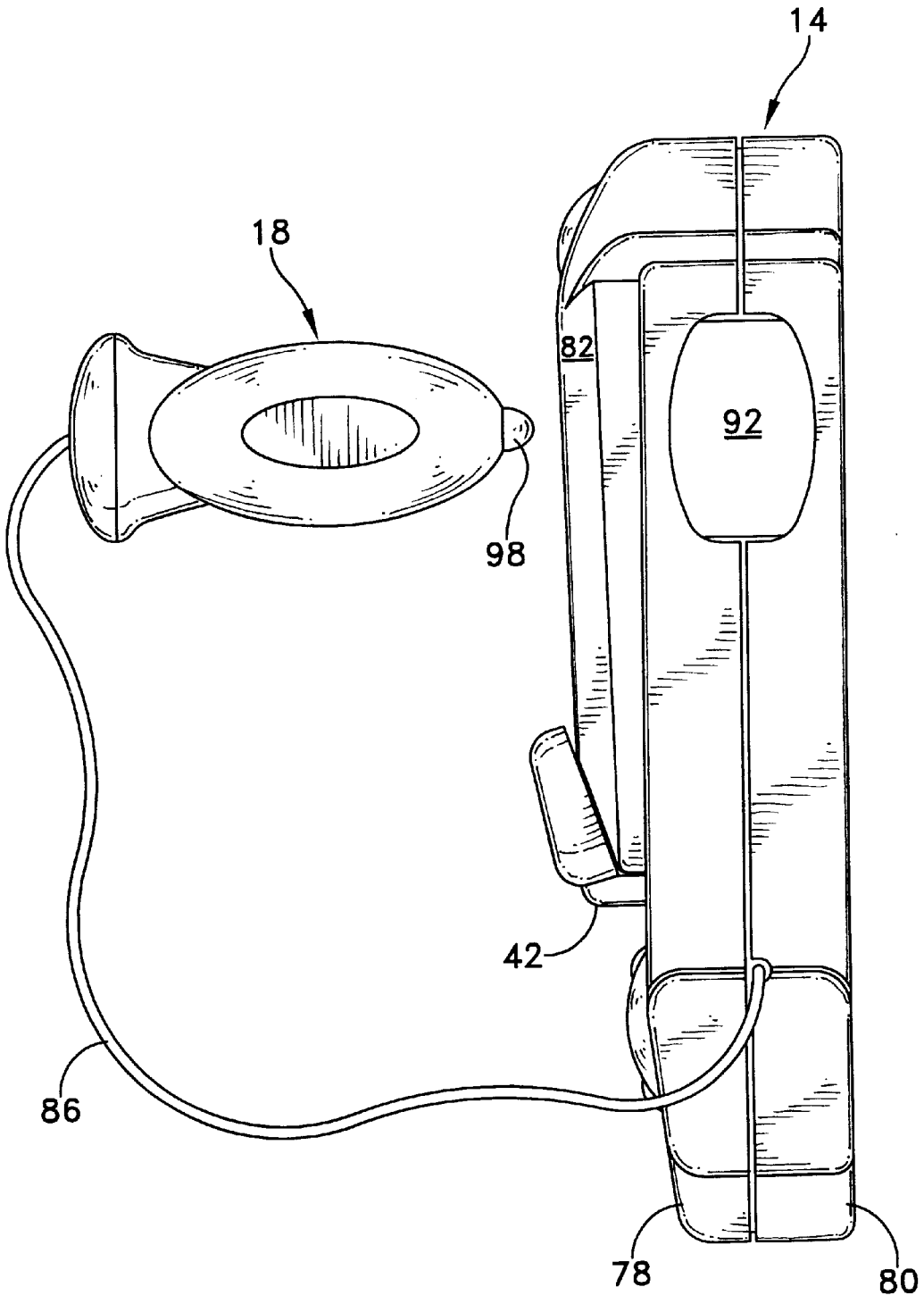
FIG. 4 is a side view of the magnetically responsive writing device of FIG. 3.

Referring now to FIGS. 1 and 4, the housing 14 which supports the writing tablet and output device will now be described. The housing preferably defines an inner cavity and includes front member 78 and rear member 80 which, when engaged, form the housing. The front member 78 preferably includes a window 82 through which the writing surface of the tablet is visible and engageable by the stylus. The front member preferably also includes the slot 44 for receiving the engagement member 42 of the magnetic eraser, the one or more buttons 76 which, when depressed by a user, also activate the output device, a speaker housing 86, and may include indica 88 visible through an opening 90 in the engagement member as the engagement member is slid within the slot. The rear member 80 preferably supports the power supply 68 on a rear surface thereof, and may support various other components of the device, including the holders 50 which engage the pins 48 supported on the tablet mounting member 26 for rotatably supporting the tablet within the cavity of the housing (not shown). The front and rear members together preferably form a recess 92 for storing the stylus 18, when the stylus is not being utilized. The stylus may be elliptical in shape, and the recess may preferably include protrusions 94 (FIG. 5) which engage and hold the stylus within the recess. The stylus may be further secured to the housing by a line 96 connected at one end to the stylus and supported at a second end within the housing so as to prevent the stylus from being accidentally lost by the user. The stylus may preferably be made of a plastic material, and includes a magnetically attractive tip 98, as is known in the art. It should be appreciated that the shape, size and location of the stylus may be readily varied, as would be known to one of skill in the art.

Use of the magnetic writing device 10 will now be described with reference to the drawings.

In use, the stylus 18 is removed from within the recess 92 and the magnetically attractive tip 98 is engaged with the writing surface 34 of the tablet 12 by the user. As the user presses the tip against the writing surface, the tablet is rotated about the hinge member 46 in the direction of arrow "A", i.e. toward the rear member 80 of the housing 14, until a portion of the tablet (for example, the mounting member 26) contacts the switch 58. As the switch is contacted and actuated by the tablet it closes the circuit to electrically activate the circuit board 62 and produce a pre-determined output, such as a pre-recorded sound. In the present embodiment, the output device produces one of number of a pre-recorded sounds which are emitted through the speaker 70. After the user contacts the writing surface with the magnetically attractive stylus, the magnetic particles are attracted by the magnetic force of the stylus and move toward the surface of the writing surface to produce a visual representation (i.e., words or drawing) created by the user. Once the user completes his or her drawing on the writing surface and the pressure is released, the tablet rotates back into its non-actuated position spaced from the switch. In this manner, the switch is no longer activated and the output device ceases producing the output. The output (such as a sound) may either be continuous (i.e. Continue as long as the switch is actuated), or the output may be a single output activated each time the switch is actuated (i.e. a single output when the switch is initially actuated and another output once the switch is released and thereafter actuated again). The user may, at his or her discretion, erase the visual representation by moving the engagement member 42 within the slot 44 so as to move the magnet 38 along the length of the eraser surface to "erase" the writing surface by attracting the magnetic particles from the writing surface toward the eraser surface. If desired, the user can depress the buttons 76 on the housing to also activated the output device.

It will be understood that various modifications may be made to the embodiments disclosed herein. For example, various types of magnetic media may be utilized with the writing tablet. In addition, the output produced by the output device is not limited to sounds, but may include other types of output, for example a visual output such as a blinking light, or other visual representation. Also, the writing tablet and housing may be any of a variety of shapes and sizes, as would be know to those of skill in the art. Various combinations of features described herein may or may not be utilized. For example, the writing device may or may not include one or more buttons for activating the output device and various indicia may or may not be provided on the face of the housing. Therefore, the above description should not be construed as limiting, but merely as exemplifications of preferred embodiments. Those skilled in the art will envision other modifications within the scope, spirit and intent of the invention.

What is claimed is:

1. A magnetically responsive writing device comprising:

a housing;

a magnetic tablet rotatably supported within the housing and including a writing surface and an eraser surface, the tablet further including a liquid dispersion containing-magnetic particles disposed between the writing surface and the eraser surface;

a magnetically attractive stylus constructed and arranged to engage the writing surface of the magnetic tablet and attract the magnetic particles to display a user created image;

an output device supported within the housing and actuable by movement of the tablet; and wherein as the stylus engages the writing surface, the magnetic tablet rotates to activate the output device and produce an output to a user.

2. The writing device of claim 1, wherein the magnetic tablet includes a writing display panel supported on a mounting member and having a gap disposed therebetween.

3. The writing device of claim 2, further comprising a magnetic eraser disposed within the gap and constructed and arranged to magnetically attract the particles from the writing surface toward the eraser surface.

4. The writing device of claim 3, wherein the magnetic eraser includes a magnet mounted within a support, and wherein the support is rotatably supported within the housing so as to rotate as the tablet is rotated.

5. The writing device of claim 2, wherein the tablet is rotatably supported within the housing by a hinge member.

6. The writing device of claim 5, wherein the hinge member includes a pair of engagement pins supported on the mounting member, the pins being rotatably supported within holders supported within the housing.

7. The writing device of claim 1, wherein the output device includes a switch constructed and arranged to be engaged by the writing tablet as the tablet is rotated, and a circuit board activated when the switch is engaged to produce the output.

8. The writing device of claim 1, wherein the output is an audio output.

9. The writing device of claim 1, further comprising one or more buttons engageable by a user to activate the output device.

10. A magnetically responsive writing device comprising:

a housing;

a magnetic tablet rotatably supported within the housing and including a writing surface and an eraser surface, the tablet further including a liquid dispersion containing magnetic particles disposed between the writing surface and the eraser surface;

a magnetically attractive stylus constructed and arranged to engage the writing surface of the magnetic tablet and attract the magnetic particles to display a user created image;

a magnetic eraser including a magnet mounted within a support, the support being rotatably supported within the housing;

an output device supported within the housing and actuable by movement of the tablet; and wherein as the stylus engages the writing surface, the magnetic tablet rotates to activate the output device and produce an output to a user, and the magnetic eraser also rotates.

11. The writing device of claim 10, wherein the magnetic tablet includes a writing display panel supported on a mounting member and having a gap disposed therebetween.

12. The writing device of claim 11, wherein the magnetic eraser is disposed within the gap and is constructed and arranged to magnetically attract the particles from the writing surface toward the eraser surface.

13. The writing device of claim 11, wherein the tablet is rotatably supported within the housing by a hinge member.

14. The writing device of claim 13, wherein the hinge member includes a pair of engagement pins supported on the mounting member, the pins being rotatably supported within holders supported within the housing.

15. The writing device of claim 10, wherein the output device includes at lease one switch constructed and arranged to be engaged by the writing tablet as the tablet is rotated, and a circuit board activated when the switch is engaged to produce the output.

16. The writing device of claim 10, wherein the output is an audio output.

17. The writing device of claim 10, further comprising one or more buttons engageable by a user to activate the output device.

18. A magnetically responsive writing device comprising:

a housing;

a magnetic tablet rotatably supported within the housing and including a writing display panel having a writing surface and an eraser surface, the display panel being supported on a mounting member, the magnetic tablet further including a liquid dispersion containing magnetic particles disposed between the writing surface and the eraser surface and a gap disposed between the display panel and the mounting member;

a magnetically attractive stylus constructed and arranged to engage the writing surface of the magnetic tablet and attract the magnetic particles to display a user created image;

a magnetic eraser constructed and arranged to magnetically attract the particles from the writing surface toward the eraser surface;

an output device supported within the housing and actuable by movement of the tablet; and wherein as the stylus engages the writing surface, the magnetic tablet rotates to activate the output device and produce an output to a user.

19. The writing device of claim 18, wherein the magnetic eraser is disposed within the gap and includes a magnet mounted within a support, and wherein the support is rotatably supported within the housing so as to rotate as the tablet is rotated.

20. The writing device of claim 18, wherein the output device includes at lease one switch constructed and arranged to be engaged by the writing tablet as the tablet is rotated, and a circuit board activated when the switch is engaged to produce the output.

21. A magnetically responsive writing device comprising:

a housing;

a magnetic tablet rotatably supported within the housing and including a writing display panel having a writing surface and an eraser surface, the display panel being supported on a mounting member and further including a liquid dispersion containing magnetic particles disposed between the writing surface and the eraser surface and a gap disposed between the display panel and the mounting member;

a magnetically attractive stylus constructed and arranged to engage the writing surface of the magnetic tablet and attract the magnetic particles to display a user created image;

a magnetic eraser disposed in the gap and including a magnet constructed and arranged to magnetically attract the particles from the writing surface toward the eraser surface, the magnet being mounted within a support rotatably supported within the housing;

an output means supported within the housing and actuable by movement of the tablet; and wherein as the stylus engages the writing surface, the magnetic tablet rotates to activate the output means and produce an output to a user, and the magnetic eraser also rotates.

22. The writing device of claim 21, wherein the output means includes at lease one switch constructed and arranged to be engaged by the writing tablet as the tablet is rotated, and a circuit board activated when the switch is engaged to produce the output.

23. A magnetically responsive writing device comprising:

a housing;

a magnetic tablet movably supported within the housing and including a writing surface and an eraser surface, the tablet further including a liquid dispersion containing magnetic particles disposed between the writing surface and the eraser surface;

a magnetically attractive stylus constructed and arranged to engage the writing surface of the magnetic tablet and attract the magnetic particles to display a user created image;

an output device supported within the housing and actuable by movement of the tablet; and wherein as the stylus engages the writing surface, the magnetic tablet moves to activate the output device and produce an output to a user.

24. The magnetically response writing device of claim 23, wherein the magnetic tablet is rotatably supported for movement within the housing.

25. The writing device of claim 23, wherein the output device includes a switch constructed and arranged to be engaged by the writing tablet as the tablet moves, and a circuit board activated when the switch is engaged to produce the output.

26. The writing device of claim 23, wherein the output is an audio output.

* * * * *